US008181772B2

(12) United States Patent
Short et al.

(10) Patent No.: US 8,181,772 B2
(45) Date of Patent: May 22, 2012

(54) DISPENSER WITH CORNER LATCHES

(75) Inventors: Martin Short, Jersey City, NJ (US); Robert Croft, Jersey City, NJ (US)

(73) Assignee: Purdue Pharma L.P., Stamford, CT (US)

( * ) Notice: Subject to any disclaimer, the term of this patent is extended or adjusted under 35 U.S.C. 154(b) by 596 days.

(21) Appl. No.: 11/772,780

(22) Filed: Jul. 2, 2007

(65) Prior Publication Data

US 2009/0008401 A1 Jan. 8, 2009

(51) Int. Cl.
*A45C 13/10* (2006.01)

(52) U.S. Cl. ..... 206/1.5; 206/532; 206/531; 70/63; 220/826

(58) Field of Classification Search ..... 220/826, 220/324, 676, 817, 837, 839, 833; 206/538, 206/528, 539, 532, 531, 533, 1.5; 70/63; 221/151, 154

See application file for complete search history.

(56) References Cited

U.S. PATENT DOCUMENTS

| | | | | |
|---|---|---|---|---|
| 3,888,350 | A * | 6/1975 | Horvath | 206/531 |
| 4,113,098 | A * | 9/1978 | Howard | 206/540 |
| 4,126,224 | A | 11/1978 | Laauwe et al. | |
| 4,381,836 | A * | 5/1983 | Rivkin et al. | 206/387.11 |
| 4,538,731 | A * | 9/1985 | Cillario | 206/540 |
| 4,718,547 | A | 1/1988 | MacTavish | |
| 4,765,125 | A * | 8/1988 | Fafournoux | 53/512 |
| 4,782,977 | A | 11/1988 | Watanabe et al. | |
| 4,881,645 | A | 11/1989 | Smiler et al. | |
| 5,080,222 | A | 1/1992 | McNary | |
| 5,082,137 | A | 1/1992 | Weinstein | |
| 5,147,034 | A * | 9/1992 | Broadhead et al. | 206/1.5 |
| 5,275,291 | A | 1/1994 | Sledge | |
| 5,368,162 | A * | 11/1994 | Holmgren | 206/387.11 |
| 5,454,932 | A | 10/1995 | Tardif et al. | |
| 5,573,741 | A * | 11/1996 | Riley | 422/300 |
| 5,882,052 | A * | 3/1999 | Whitehead | 292/80 |
| 6,168,073 | B1 | 1/2001 | Towle | |
| D460,352 | S | 7/2002 | Bried | |
| 6,430,976 | B1 * | 8/2002 | Mitsuyama | 70/57.1 |
| 6,581,264 | B2 * | 6/2003 | Ohori et al. | 29/426.1 |

(Continued)

FOREIGN PATENT DOCUMENTS

| | | |
|---|---|---|
| DE | 1586915 | 8/1970 |

(Continued)

OTHER PUBLICATIONS

U.S. Appl. No. 29/281,816, Short et al., Container, filed Jul. 2, 2007.

(Continued)

*Primary Examiner* — Mickey Yu
*Assistant Examiner* — Kareen Rush
(74) *Attorney, Agent, or Firm* — Sterne, Kessler, Goldstein & Fox P.L.L.C.

(57) ABSTRACT

A dispenser having a storage compartment may hold a blister package or other object. The blister package may be slid in and out of the dispenser through an opening. Corner latches pivotally attached to the dispenser on either side of the opening move between a first position and a second position. In the first position, a portion of the corner latches extend into the opening thereby preventing the object from being removed from the dispenser. The corner latches are moved to the second position such that the corner latches no longer block the opening to the dispenser so that the blister package may be removed.

8 Claims, 3 Drawing Sheets

U.S. PATENT DOCUMENTS

| | | | | |
|---|---|---|---|---|
| 6,789,677 | B2 * | 9/2004 | Maietta | 206/536 |
| 6,789,692 | B2 * | 9/2004 | Prezelin | 220/324 |
| 6,814,225 | B2 * | 11/2004 | Belden et al. | 206/1.5 |
| 6,832,498 | B2 * | 12/2004 | Belden et al. | 70/57.1 |
| 6,841,225 | B2 * | 1/2005 | Bottari | 428/192 |
| 6,848,662 | B2 * | 2/2005 | Paramonoff et al. | 248/309.1 |
| 6,905,015 | B2 * | 6/2005 | Hernandez et al. | 206/45.24 |
| D513,584 | S | 1/2006 | Solowiejko et al. | |
| 7,090,079 | B2 | 8/2006 | Ehrlund | |
| 7,093,736 | B2 | 8/2006 | Maietta et al. | |
| D592,528 | S | 5/2009 | Short et al. | |
| 2003/0042167 | A1 * | 3/2003 | Balz et al. | 206/531 |
| 2003/0080021 | A1 * | 5/2003 | Kopecky | 206/531 |
| 2003/0111379 | A1 * | 6/2003 | Intini | 206/531 |
| 2005/0183981 | A1 * | 8/2005 | Gelardi | 206/531 |
| 2006/0049078 | A1 * | 3/2006 | Sams et al. | 206/528 |
| 2006/0138014 | A1 * | 6/2006 | Drought et al. | 206/528 |
| 2006/0283760 | A1 * | 12/2006 | Nivala | 206/531 |

FOREIGN PATENT DOCUMENTS

| | | | |
|---|---|---|---|
| GB | 2316062 | A | 2/1998 |
| WO | WO 03/070598 | A1 | 8/2003 |

OTHER PUBLICATIONS

International Search Report for corresponding International Application No. PCT/US2008/007495, European Patent Office, mailed Oct. 1, 2008, 3 pgs.

Written Opinion of the International Searching Authority for corresponding International Application No. PCT/US2008/007495, European Patent Office, mailed Oct. 1, 2008, 5 pgs.

* cited by examiner

DISPENSER WITH CORNER LATCHES

CROSS REFERENCE TO RELATED APPLICATIONS

This application is related to U.S. patent application Ser. No. 29/281,816 filed on Jul. 2, 2007, now U.S. Design Pat. No. D592,528.

BACKGROUND OF THE INVENTION

1. Field of the Invention

The present invention is directed to a dispenser having corner latches.

2. Background Art

Blister packages are a common packaging for holding a variety of items, such as pharmaceutical products or chewing gum. Blister packages are designed to permit items to be easily removed through the exertion of a slight pressure. However, this design feature may lead to items accidentally breaking free from the package when carried about in a person's pocket or bag as a result of inadvertent external pressure. Dispenser cases or containers that protect and hold a blister package are available, however they often have complex features to prevent the blister packages from escaping the dispenser.

BRIEF SUMMARY OF THE INVENTION

Disclosed herein is a dispenser having a first wall, a second wall opposed to the first wall and a third wall connecting the first wall to the second wall to form a hollow storage compartment having an opening disposed between the first, second, and third walls. A first reusable latch is pivotally attached to the third wall adjacent a first side of the opening, wherein the first latch pivots between a first, or closed, position wherein a portion of the first latch extends into, and at least partially occludes, the opening to prevent removal of an object from the hollow storage compartment and a second, or open, position wherein the portion of the first latch is positioned away from the opening to permit removal of the object from the hollow storage compartment.

A second reusable latch may also be pivotally attached to the third wall adjacent a second side of the opening, wherein the second latch pivots between a first, or closed, position wherein a portion of the second latch extends into, and at least partially occludes, the opening to prevent removal of the object from the hollow storage compartment and a second, or open, position wherein the portion of the second latch is positioned away from the opening to permit removal of the object from the hollow storage compartment. In one embodiment where both first and second latches are present, both first and second latches will need to be in the second or open positions to permit removal of the object from the hollow storage compartment.

BRIEF DESCRIPTION OF THE DRAWINGS/FIGURES

DETAILED DESCRIPTION OF THE INVENTION

Figure 1:
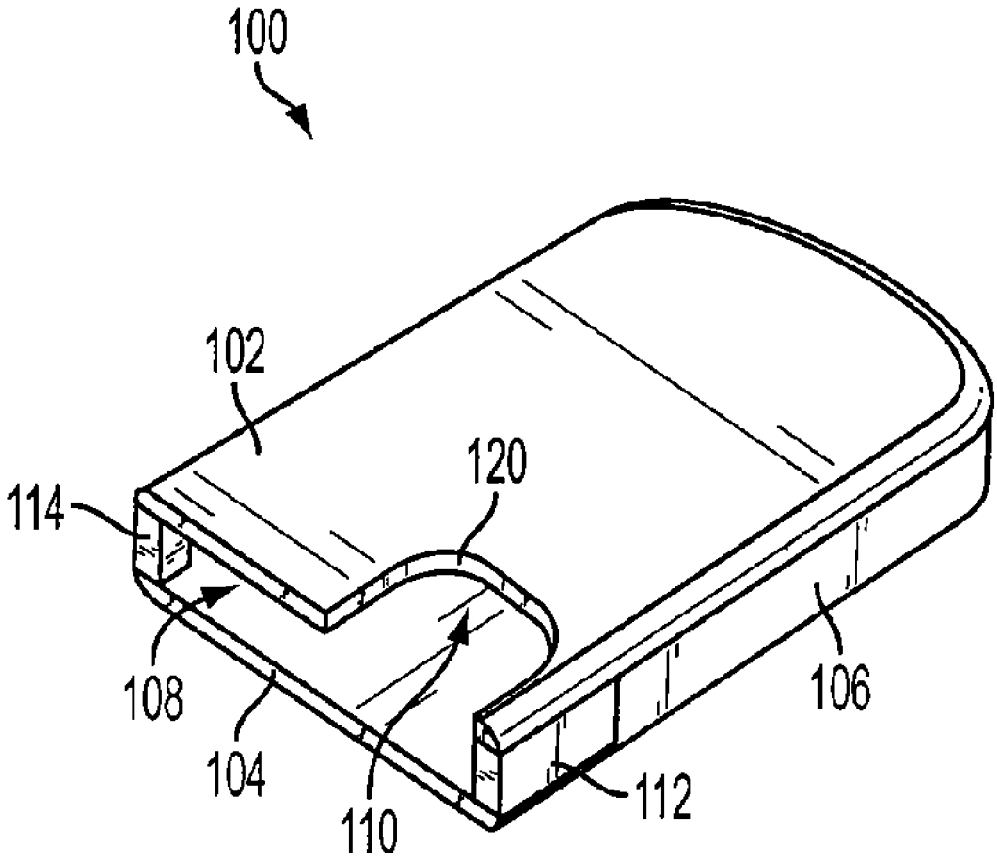
FIG. 1 is a perspective view of an exemplary dispenser with first and second reusable latches each in a closed position
Figure 2:
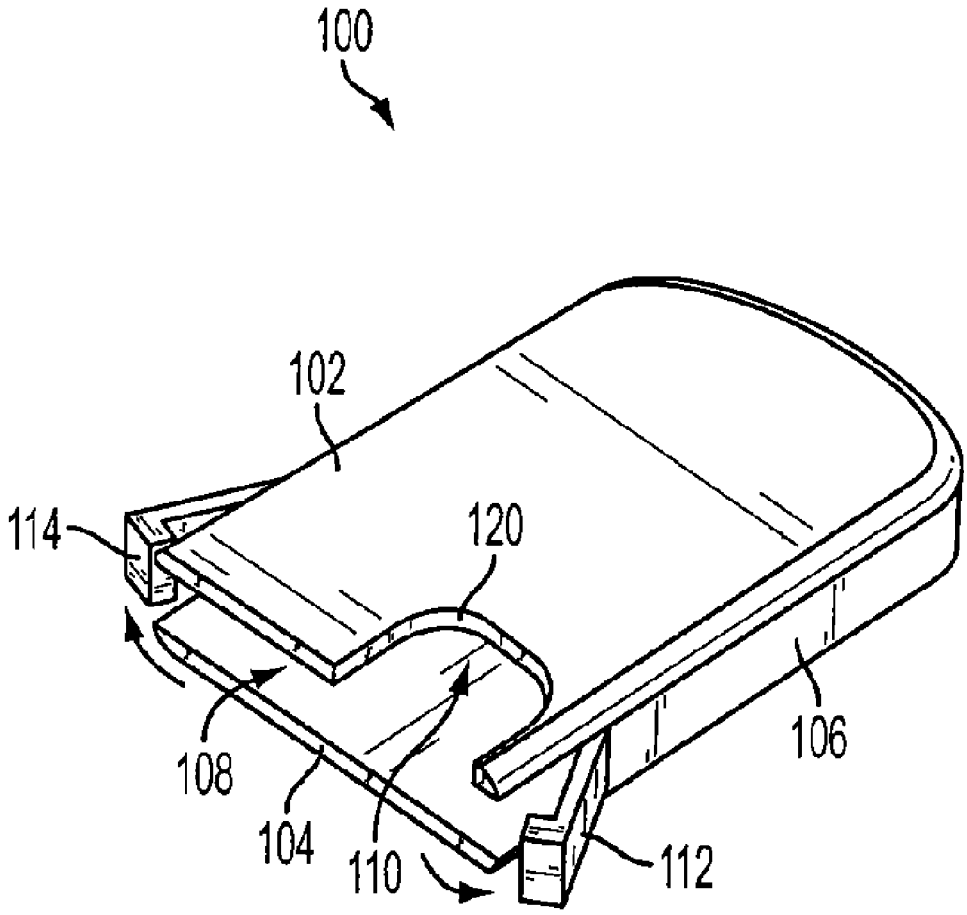
FIG. 2 is a perspective view of an exemplary dispenser with first and second reusable latches each in an open position.
Figure 3:
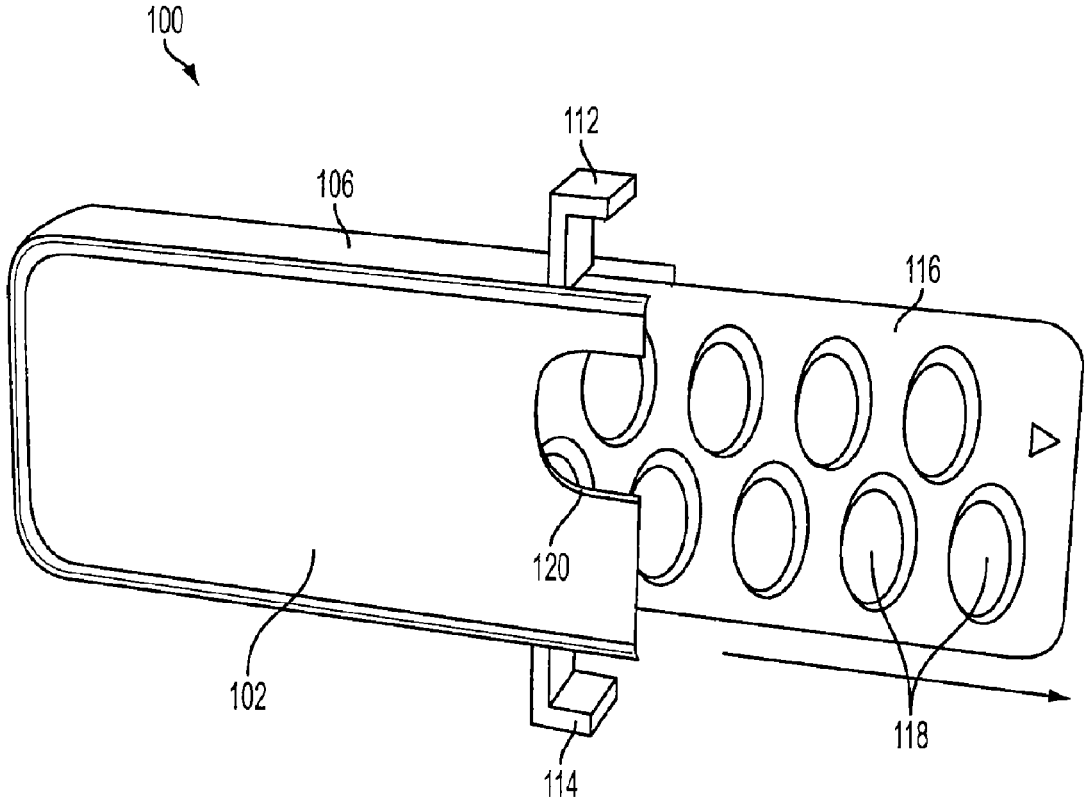
FIG. 3 is a perspective view of an exemplary dispenser with first and second reusable latches each in an open position, and with an object, in this case a blister package, partially removed from a hollow storage compartment.

Disclosed herein is a dispenser 100 which will be described with reference to FIGS. 1-3. Dispenser 100 may have a first wall 102 and an opposing second wall 104 that are connected together by a third wall 106. As shown in FIGS. 1-3, both first wall 102 and second wall 104 may be flat. Third wall 106 may connect all but a portion of a periphery of first and second walls 102, 104 to form an opening 108 leading to a hollow storage compartment 110. Storage compartment 110 may thus be defined by first, second, and third walls, 102, 104, and 106.

A first latch 112 may be pivotally attached to one end of third wall 106 adjacent a first side of opening 108 and a second latch 114 may be pivotally attached to another end of third wall 106 adjacent a second side of opening 108, as described below. As seen in FIGS. 2 and 3, first and second latches 112, 114 may be L-shaped corner latches such that at least a portion of each of first and second latches 112, 114 extend into opening 108 to occlude opening 108 when in a closed position as shown for example in FIG. 1. First and second latches 112, 114 are reusable and may be pivoted back and forth between a closed position, as shown in FIG. 1, and an open position, as shown in FIGS. 2 and 3, as many times as desired.

First and second latches 112, 114 may each be attached to third wall 106 by, and pivot about, a living hinge, i.e. a thin portion of plastic that provides the ability to flex repeatedly without the use of a mechanical hinge. First and second latches 112, 114 and the corresponding living hinges may be integrally molded as part of dispenser 100. Dispenser 100 and all its component parts may be integrally molded from a suitable polymeric material such as, for example, polypropylene. Alternatively, first and second latches 112, 114 may be molded as separate components and attached to dispenser 100, in such an instance first and second latches 112, 114 may by molded from a suitable polymeric material such as, for example, polypropylene, polystyrene, polyethylene terephthalate or high density polyethylene.

First and second latches 112, 114 may move from a closed position to an open position when a user exerts pressure to push or pull first and second latches 112, 114 outward away from opening 108. First and second latches 112, 114 may move from an open position to a closed position when a user exerts pressure to push first and second latches 112, 114 inward toward opening 108. First and second latches 112, 114 may remain in a closed position by a function fit with first and second walls 102, 104. First and second latches 112, 114 may have slight bumps on edges thereof that fit into small recesses in first and second walls 102, 104. Alternatively, one or both of first and second walls 102, 104 may have an extension extending into hollow storage compartment 110 that first and second latches 112, 114 move past to move between the closed and open positions. If first and second latches 112, 114 are separately molded components attached to dispenser 100, there may be an interference fit within a pivot area that keeps first and second latches 112, 114 in the closed position.

Hollow storage compartment 110 may be sized and shaped to be substantially the same size and shape of an object disposed therein. The object held in storage compartment 110 may be, for example, a blister package having a plurality of products packaged therein, such as, for example, separate solid doses of a pharmaceutical product, or candy, or chewing gum. Hollow storage compartment 110 may be sized and shaped such that both first and second latches 102, 104 must be in the open position to permit removal of the object from dispenser 100. Alternatively, hollow storage compartment 110 may be sized and shaped such that only one of first and second latches 102, 104 needs to be in the open position to permit removal of the object from dispenser 100.

FIG. 3 illustrates the removal of an exemplary object, in this case a blister package 116 having a plurality of dosages of a pharmaceutical product 118, from dispenser 100. Blister package 116 is merely one example of an object that can be dispensed from dispenser 100. Opening 108 leading to hollow storage compartment 110 may have a width that is substantially the same as the width of blister package 116 held in storage compartment 110. When first and second latches 112, 114 are in a closed position, as shown in FIG. 1, portions of first and second latches 112, 114 extending into opening 108 prevent blister package 116 from being removed as first and second latches 112, 114 block blister package 116 from being removed from storage compartment 110 through opening 108. As shown in FIG. 3, when first and second latches 112, 114 are pivoted to an open position, first and second latches 112, 114 no longer prevent removal of blister package 116 and blister package 116 may be pulled out of storage compartment 110. One or both of first and second walls 102, 104 may optionally have a notch 120 adjacent opening 108 through which a leading edge of blister package 116 may be visible and that provides a space for fingers to grip blister package 116 to facilitate pulling blister package 116 out of storage compartment 110. Blister package 116 may be fully or partially removed such that one or more dosages of pharmaceutical product 118 may then be broken free. Blister package 116 may then be placed completely back into storage compartment 110 while first and second latches 112, 114 are in the open position and afterwards first and second latches 112, 114 may each be pivoted to their respective closed positions.

Latches 112, 114 provide an easily operated and manufactured mechanism for preventing an object from accidentally sliding out of dispenser 100.

The foregoing description of the specific embodiments will so fully reveal the general nature of the invention that others can, by applying knowledge within the skill of the art, readily modify and/or adapt for various applications such specific embodiments, without undue experimentation, and without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A dispenser comprising:

a first wall;

a second wall opposed to said first wall;

a third wall connecting said first wall and said second wall to form a hollow storage compartment having an opening disposed between said first, second, and third walls;

a first reusable latch pivotally attached to said third wall adjacent a first side of said opening, wherein said first reusable latch is capable of pivoting multiple times between a first position wherein a portion of said first reusable latch extends into said opening to prevent removal of an object from said hollow storage compartment and a second position wherein said portion of said first reusable latch is positioned away from said opening to permit removal of an object from said hollow storage compartment; and a second reusable latch pivotally attached to said third wall adjacent a second side of said opening, wherein said second reusable latch is capable of pivoting multiple times between a first position wherein a portion of said second reusable latch extends into said opening, to prevent removal of an object from said hollow storage compartment and a second position wherein said portion of said second reusable latch is positioned away from said opening to permit removal of an object from said hollow storage compartment, wherein said first and second reusable latches are maintained in said first position through a friction fit.

2. The dispenser of claim 1, wherein an object in said hollow storage compartment can only be removed when both of said latches are in the second position.

3. The dispenser of claim 1, wherein each of said latches pivot about a living hinge.

4. The dispenser of claim 1, wherein at least one of said first and second walls has a notch adjacent said opening through which an object in said hollow storage compartment is visible and may be gripped to remove it from said hollow storage compartment.

5. The dispenser of claim 1, wherein the dispenser is sized to receive a blister package disposed in said hollow storage compartment.

6. The dispenser of claim 1, wherein the dispenser is sized to receive a blister package containing a plurality of dosages of a pharmaceutical product.

7. The dispenser of claim 1, wherein a material for said dispenser is polypropylene.

8. The dispenser of claim 1, wherein said third wall connects said first and second walls along multiple sides of said dispenser.

* * * * *